US007128172B2

(12) United States Patent
Cosic et al.

(10) Patent No.: US 7,128,172 B2
(45) Date of Patent: Oct. 31, 2006

(54) DRILL STRING FOR UPWARD DRILLING AND COMPONENTS THEREFOR

(75) Inventors: Vlado Cosic, Benoni (ZA); Aimo Helin, Tampere (FI)

(73) Assignee: Sandvik Intellectual Property AB, Sandviken (SE)

( * ) Notice: Subject to any disclaimer, the term of this patent is extended or adjusted under 35 U.S.C. 154(b) by 0 days.

(21) Appl. No.: 10/882,627

(22) Filed: Jul. 2, 2004

(65) Prior Publication Data

US 2005/0056466 A1 Mar. 17, 2005

(30) Foreign Application Priority Data

Jul. 7, 2003 (ZA) ..... 03/5240

(51) Int. Cl.
*E21B 17/00* (2006.01)

(52) U.S. Cl. ..... 175/320; 175/417; 173/104

(58) Field of Classification Search ..... 175/135, 175/415, 320, 417; 173/104, 105
See application file for complete search history.

(56) References Cited

U.S. PATENT DOCUMENTS 3,554,306 A * 1/1971 Wilburn ..... 175/320
4,296,821 A * 10/1981 Larson ..... 175/87
5,415,240 A * 5/1995 Mundjar ..... 173/48
6,092,612 A * 7/2000 Brady ..... 175/325.2
6,102,141 A * 8/2000 Engstrom et al. ..... 175/417
6,241,033 B1 6/2001 Hoffman
6,293,360 B1 * 9/2001 Liljebrand et al. ..... 175/320

FOREIGN PATENT DOCUMENTS

SE 509 425 4/1996

* cited by examiner

*Primary Examiner*—William Neuder
*Assistant Examiner*—Nicole A Coy
(74) *Attorney, Agent, or Firm*—Drinker Biddle & Reath LLP

(57) ABSTRACT

A rock drill includes a housing in which are disposed a reciprocable percussive device, slidably mounted in the housing, a rotary device, and a shank adapter aligned with the percussive device. The shank adapter includes first and second adapter portions. The first adapter portion has a front end and a rear end, the rear end arranged to be impacted by the percussive device and rotated by the rotary device. The second adapter portion has a rear end releasably connected to the front end of the first adapter portion, and a front end carrying a coupling adapted for connection with a drill rod component.

17 Claims, 2 Drawing Sheets

DRILL STRING FOR UPWARD DRILLING AND COMPONENTS THEREFOR

This application claims priority under 35 U.S.C. §§ 119 and/or 365 to patent application Ser. No. 2003/5240 filed in South Africa on Jul. 7, 2003, the entire content of which is hereby incorporated by reference.

FIELD OF INVENTION

The invention relates to a rock drill for upwards drilling a drill string and components therefor.

BACKGROUND OF THE INVENTION

A typical rock drill comprises a shank adapter, percussion device and rotating device. A drill string can be fastened to the shank adapter, to which rotation torque is transmitted from the rotating device by means of the shank adapter and impact pulses are transmitted from the percussion device. The percussion device generally comprises a reciprocating percussion piston arranged to provide impacts to an impact surface located outermost at the back end of the shank adapter.

This type of drill has a certain minimum length and, in practice, it cannot be made shorter than the minimum length. The minimum length is determined by the length of the percussion piston and shank adapter, the stroke length of the percussion piston and the remaining structure of the drill, such as the end covers. When quarrying in low spaces, for instance in tunnels, it is advantageous to use as short a drill as possible so as to be able to use drill strings of a practical length, especially for upwards drilling. However, the length of the drill cannot be shortened without shortening the length of the percussion piston and shank adapter. If the percussion piston is made very short, it is no longer possible to provide therewith the impact pulses needed to break rock, and the performance of the drill is substantially reduced. The shank adapter, too, should have a certain length so that drill strings can be firmly fastened to it and that it can be firmly supported in the body of the drill. In addition, the rotation torque required to rotate the shank adapter should be transmitted to the shank adapter. The stroke of the percussion piston also cannot be shortened very much without a harmful effect on the impact pulses transmitted to the shank adapter.

It is expensive to produce conventional one-piece shank adapters having splines at the back end, and a coupling, e.g., a thread or a hexagonal connector, at the free end for connection with the drill string. Moreover, since the adapter is a part that needs relatively frequent replacement, due mainly to wearing at the coupling (free) end thereof, there may be appreciable costs associated with the use of such drills.

An object of the invention is to provide a rock drill having a shank adapter that can be replaced more easily and at less cost.

It is another object of the present invention to provide a novel and improved rock drill shank adapter for percussive rock drilling.

Another object of the present invention to provide a novel and improved rock drill shank adapter for percussive rock drilling that is easily replaceable.

Still another object of the present invention to provide a novel and improved rock drill shank adapter for percussive rock drilling that is replaceable without dismounting the drill.

Another object of the present invention to provide drill string components for percussive rock drilling that are easily replaceable.

SUMMARY OF INVENTION

One aspect of the invention relates to a drill string for percussive rock drilling comprising a shank adapter, an extension rod, a starter rod, and a drill bit all arranged in series, wherein a rear end of the drill bit and a front end of the starter rod are configured for releasable interconnection. A rear end of the starter rod and a front end of the extension rod are configured for releasable interconnection; and a rear end of the extension rod being configured for releasable inter-connection with the shank adapter. The shank adapter, the extension rod, the starter rod, and the drill bit are configured for transmitting impact waves and conducting flushing medium. The shank adapter comprises first and second adapter portions. A front end of the first adapter portion is configured for releasable interconnection with a rear end of the second adapter portion, and a front end of the second adapter portion is configured for releasable interconnection with the rear end of the extension rod.

Another aspect of the invention relates to a shank adapter for percussive rock drilling, comprising a first adapter portion and a second adapter portion aligned with the first adapter portion. A rear end of the second adapter portion is configured for releasable interconnection with a front end of the first adapter portion. A flushing channel extends through the first and second adapter portions. The first and second adapter portions engage one another for transmitting impact waves.

Yet another aspect of the invention relates to a starter rod for percussive rock drilling, comprising a non-cylindrical portion defining a center axis and having at one end thereof a sleeve forming an axially open recess. The recess has a non-cylindrical internal wall and terminates in an impact-transmitting surface oriented substantially perpendicular to the axis. A flushing channel extends through the starter rod. A portion of the flushing channel is defined by the recess. A total length of the starter rod is less than one meter.

Yet an additional aspect of the invention pertains to an extension rod for percussive rock drilling, comprising a non-cylindrical portion defining a center axis and having at a first end thereof a sleeve forming an axially open recess. The recess has a non-cylindrical internal wall and terminates in a first impact-transmitting surface oriented substantially perpendicular to the axis. The non-cylindrical portion has at a second end thereof a non-cylindrical outer periphery shaped correspondingly to the internal wall of the recess. The second end terminates in a second impact-transmitting surface oriented substantially perpendicular to the axis.

One further aspect of the invention involves a percussive rock drilling apparatus comprising a housing, a reciprocable percussive device slidably mounted in the housing, a rotary device, and a shank adapter aligned with the percussive device. The shank adapter comprises first and second adapter portions. The first adapter portion is arranged to be rotated by the rotary device, and has a front end and a rear end. The rear end is arranged to be impacted by the percussive device. The second adapter portion has a rear end releasably connected to the front end of the first adapter portion, and a front end carrying a coupling adapted for connection with a drill rod component.

BRIEF DESCRIPTION OF THE DRAWINGS

Below embodiments of the invention will be described, reference being made to the appended drawings, where.

DETAILED DESCRIPTION OF THE PREFERRED EMBODIMENTS

Figure 1A:
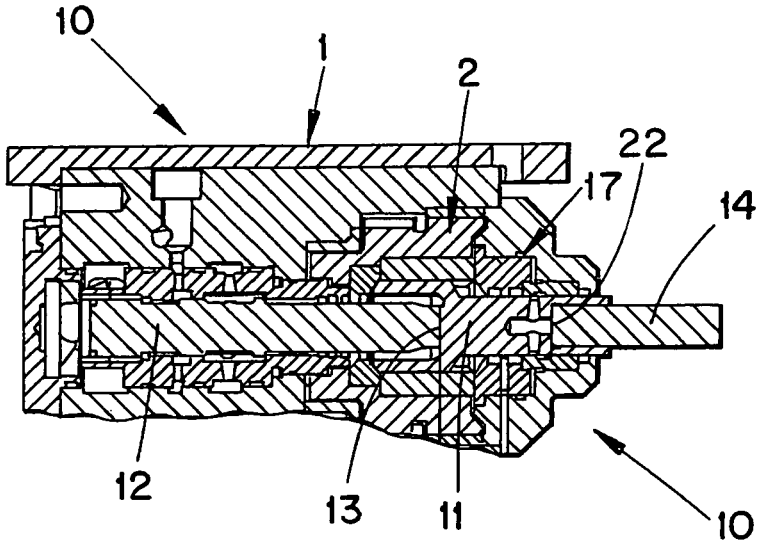
FIG. 1A is a sectional schematic fragmentary view of a rock drill showing a piston, a first shank adapter portion, and a second shank adapter portion.
Figure 1B:
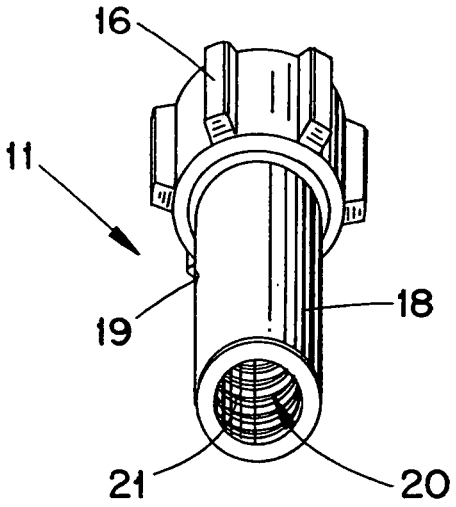
FIG. 1B is a perspective view of the first shank adapter portion.
Figure 1C:
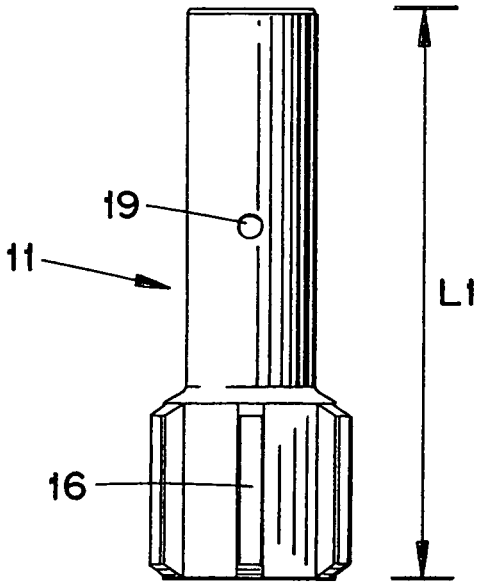
FIG. 1C is a side view of the first shank adapter portion.

FIGS. 1A and 1B show a rock drill 10 according to the invention. The drill 10 has a housing 1 in which is disposed a conventional reciprocable percussion piston 12 arranged to strike an impact surface 13 at the back end of a first shank adapter portion 11, forming impact pulses. The first shank adapter portion 11 transmits the impact pulses to a second shank adapter portion 14 and then through a drill string to a drill bit 15 which applies the pulses to the rock being drilled. The first shank adapter portion 11 carries torsion-transmitting elements or splines 16 arranged to be driven by a conventional rotary device 2 disposed in the housing, in such a manner that the shank adapter 11, 14 and the drill string can be rotated together around a common longitudinal axis. The back end of the first shank adapter portion 11 is shaped cuplike, whereby the percussion piston 12 does not strike the outermost end of the first shank adapter portion 11 but rather strikes an impact surface 13 that is located at a distance forwardly of the back end of the first shank adapter portion 11. The spline elements 16 are formed on the outer rim of the cuplike section of the first shank adapter portion 11, whereby there remains a relatively long spline-free portion 18 of the first shank adapter portion 11, against which a flushing medium channel 19 seals and on which a rotary bearing device can be arranged. Control elements and pressure medium channels belonging to the percussion device are not shown in FIG. 1A for the sake of clarity.

The first shank adapter portion 11 comprise a recess 20 at its front end in the longitudinal direction of the first shank adapter portion 11. The recess 20 has an internal or female thread 21. The thread 21 is a rope thread, helical thread, or a trapezoid thread suitable for percussive rock drilling. The recess 20 further has a bottom surface 22 to transmit impacts waves to the second shank adapter portion 14. The first shank adapter portion 11 has a length L1.

The second shank adapter portion 14 is elongate and has a length L2, preferably the length L2 of the second shank adapter portion 14 is 60–140 mm, most preferably about 80 mm. The length L2 of the second shank adapter portion 14 is less than the length L1 of the first shank adapter portion 11. The second shank adapter portion 14 has a thread 23 at the end facing towards the first shank adapter portion 11. The thread 21 is a rope thread or a trapezoid thread suitable for percussive rock drilling. The other or free end 24 of the second shank adapter portion 14 has a non-cylindrical cross-section, such as a hexagonal or a square cross-section. The envelope surface of the portion 14 from end to end is substantially continuous in the longitudinal direction, i.e. it does not have any shoulder thereon. Instead of threads 21 and 23 discussed above, it is naturally possible to use other connection elements suitable for the purpose although tests have shown threads being more durable. A flushing channel 17 is arranged all through and along the centerline of the second shank adapter portion 14. Each end 14A, 14B of the second shank adapter portion 14 comprises an impact transferring surface that is perpendicular to the centerline of the second shank adapter portion 14.

Figure 4:
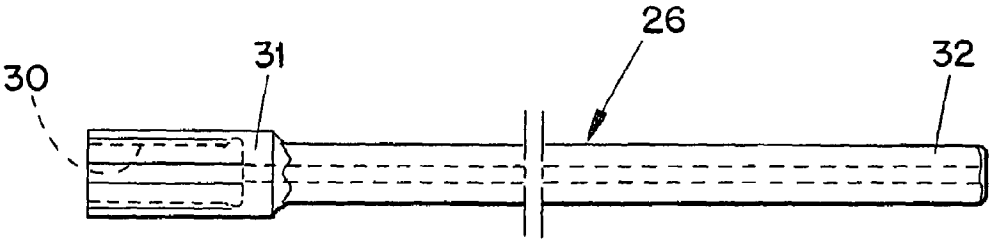
FIG. 4 is a side view of an extension rod according to the invention.
Figure 5:
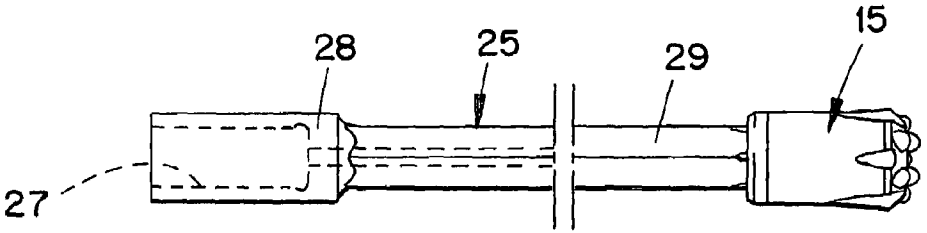
FIG. 5 is a side view of a starter rod with a drill bit.
Figure 3:
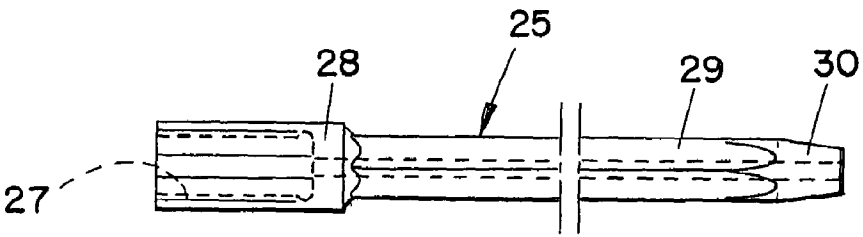
FIG. 3 is a side view of a starter rod according to the invention.
Figure 2:
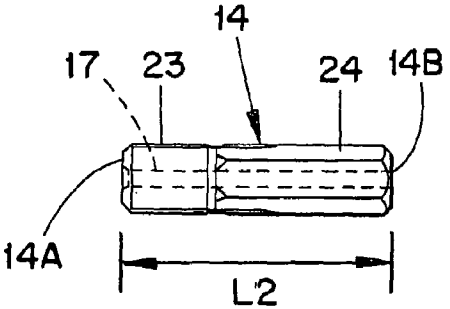
FIG. 2 is a side view of the second shank adapter portion according to the invention.

FIGS. 3, 4 and 5 show components of the drill string 4. The common space available when drilling is somewhat more than 1 meter, such as 1.1 and 1.2 m, and the total length of the hole is often longer than that limited space. Therefore, the drill string according to the present invention comprises the second shank adapter, a starter rod 25, an extension rod 26 and the drill bit 15 of limited lengths. All said components comprise flushing channels extending completely therethrough along their centerlines and each component is shorter in length than 1 meter.

The elongate starter rod 25 is about 250 to 700 mm from end to end. The starter rod comprises a female connection recess 27 having a non-cylindrical internal wall, such as a hexagonal or a square shape, to form fittingly receive the end 24 of the second shank adapter portion 14. The recess 27 is located in a sleeve 28 integral with a non-cylindrical rod portion 29. The free end of the rod portion comprises a taper 30 that is to be received by a tapered recess in the conventional drill bit 15. The female connection recess 27 comprises an impact transferring surface that is perpendicular to the centerline of the starter rod 25.

The extension rod 26 is about 600 to 750 mm from end to end. The extension rod comprises a female connection recess 30 having a non-cylindrical internal wall, such as a hexagonal or a square shape, to form fittingly receive the end 24 of the second shank adapter portion 14. The recess 30 is located in a sleeve 31 integral with a non-cylindrical rod portion 32. The free end of the rod portion 32 has a non-cylindrical cross-section, such as a hexagonal or a square cross-section that is to be received by another extension rod recess 30 or a starter rod recess 27. Each end of the extension rod comprises an impact transferring surface that is perpendicular to the centerline of the extension rod.

It will be appreciated that the two-piece adapter 11, 14 can be more easily disassembled in a confined space by first removing the second adapter portion 14 from the first adapter portion. Also, in the event that either end of the adapter wears to such an extent that replacement thereof is required, it is not necessary to replace the entire adapter. Rather, it is only necessary to replace the portion 11 or 14 that contains the worn part. If the worn part is on the second adapter portion, replacement is particularly easy since it only requires that the second adapter part be unscrewed from the first adapter part.

Although the present invention has been described in connection with preferred embodiments thereof, it will be appreciated by those skilled in the art that additions, modifications, substitutions and deletions not specifically described may be made without departing fro the spirit and scope of the invention as defined in the appended claims.

What is claimed is:

1. A drill string for percussive rock drilling comprising a shank adapter, an extension rod, a starter rod, and a drill bit, all arranged in series; wherein a rear end of the drill bit and a front end of the starter rod are configured for releasable interconnection; a rear end of the starter rod and a front end of the extension rod are configured for releasable interconnection; a rear end of the extension rod being configured for releasable inter-connection with the shank adapter; wherein the shank adapter, the extension rod, the starter rod, and the drill bit are configured for transmitting impact waves and conducting flushing medium; wherein the shank adapter comprises first and second adapter portions, a length of the second adapter portion being 60–140 mm; a front end of the first adapter portion being configured for releasable interconnection with a rear end of the second adapter portion; a front end of the second adapter portion being configured for releasable interconnection with the rear end of the extension rod.

2. The drill string according to claim 1 wherein the front end of the first adapter portion includes a recess having a female connector; the rear end of the second adapter portion including a male connector for mating with the female connector; a bottom surface of the recess being engageable with an end surface of the rear end of the second adapter portion for the transmission of impact waves; the length of the second adapter portion being less than a length of the first adapter portion.

3. The drill string according to claim 2 wherein torque-transmitting splines are disposed on an outer surface of the first adapter portion.

4. The drill string according to claim 3 wherein the outer surface that includes the splines defines a recessed cavity, and wherein the base of the recessed cavity includes an impact surface.

5. The drill string according to claim 2 wherein the male and female connectors comprise helical threads.

6. A shank adapter for percussive rock drilling, comprising a first adapter portion and a second adapter portion aligned with the first adapter portion, a length of the second adapter portion being 60–140 mm; a rear end of the second adapter portion being configured for releasable interconnection with a front end of the first adapter portion; a flushing channel extending through at least a portion of the first adapter portion and through the second adapter portion; the first and second adapter portions engaging one another for transmitting impact waves.

7. The shank adapter according to claim 6 wherein the front end of the first adapter portion includes a recess having a female connector; the rear end of the second adapter portion including a male connector for mating with the female connector; a bottom surface of the recess being engageable with an end surface of the rear end of the second adapter portion for the transmission of impact waves; the length of the second adapter portion being less than a length of the first adapter portion.

8. The shank adapter according to claim 6 wherein the male and female connectors comprise helical threads.

9. The shank adapter according to claim 8 wherein the first adapter portion includes torque-transmitting elements on an outer peripheral surface thereof.

10. The drill string according to claim 9 wherein the torque-transmitting elements are splines, and wherein the outer peripheral surface that includes the splines defines a recessed cavity, and wherein the base of the recessed cavity includes an impact surface.

11. The drill string according to claim 9 wherein the configuration of the front end of the second adapter portion permits releasable interconnection with a starter rod when an extension rod is not used.

12. The shank adapter according to claim 6 wherein the rear end of the second adapter portion and the front end of the first adapter portion are interconnected to transmit torque therebetween.

13. The shank adapter according to claim 12 wherein a front end of the second adapter portion has a non-cylindrical cross-sectional shape.

14. The shank adapter according to claim 6 wherein the rear end of the second adapter portion is connected to the front end of the first adapter portion by helical threads.

15. A starter rod for percussive rock drilling, comprising a non-cylindrical portion defining a center axis and having at one end thereof a sleeve forming an axially open recess, the recess having a non-cylindrical internal wall and terminating in an impact-transmitting surface oriented substantially perpendicular to the axis; a flushing channel extending through the starter rod; a portion of the flushing channel being defined by the recess; a total length of the starter rod being less than one meter.

16. A percussive rock drilling apparatus comprising:

a housing;

a reciprocable percussive device slidably mounted in the housing;

a rotary device; and a shank adapter aligned with the percussive device and comprising:

a first adapter portion arranged to be rotated by the rotary device and having a front end and a rear end, the rear end arranged to be impacted by the percussive device, and a second adapter portion having a rear end releasably connected to the front end of the first adapter portion, and a front end carrying a coupling adapted for connection with a drill rod component, a length of the second adapter portion being 60–140 mm.

17. The apparatus according to claim 16 wherein the rear end of the second adapter portion is threadedly connected to the front end of the first adapter portion.

* * * * *